United States Patent [19]

Iaccino et al.

[11] 3,987,654

[45] Oct. 26, 1976

[54] METHOD AND APPARATUS FOR DECODING TWISTING TUMBLER LOCKS AND LOCKS RESISTANT THERETO

[75] Inventors: George V. Iaccino; Robert A. Idoni, both of New Rochelle, N.Y.

[73] Assignee: Lock Technology, Inc., New Rochelle, N.Y.

[22] Filed: Oct. 21, 1974

[21] Appl. No.: 516,465

[52] U.S. Cl. ..... 70/364 A; 70/378; 70/394; 70/419

[51] Int. Cl.[2] ..... E05B 18/00; E05B 27/00

[58] Field of Search ..... 70/364 A, 364 R, 321, 70/322, 376, 377, 378, 394, 395, 396, 397, 398, 399, 416, 419, 421; 33/174 F

[56] References Cited

UNITED STATES PATENTS

| | | | |
|---|---|---|---|
| 14,958 | 5/1856 | Hendrickson | 70/398 X |
| 2,791,840 | 5/1957 | Harwell | 33/174 F |
| 3,499,302 | 3/1970 | Spain | 70/364 A |
| 3,837,197 | 9/1974 | Lopez | 70/364 A |

*Primary Examiner*—Robert L. Wolfe
*Attorney, Agent, or Firm*—Hubbell, Cohen, Stiefel & Gross

[57] ABSTRACT

Methods and apparatus for decoding twisting tumbler locks and improvements in such locks to resist such methods and apparatus. To determine depth of cut of bit for a given tumbler, a blade is inserted into key way to position a wirelike probe at tumbler to be decoded. Wirelike probe is advanced upwardly until it engages tit at top of tumbler. Depth of cut of key bit is function of length of tumbler and device can be calibrated to give direct readout of depth of bit cut. Angle of key bit can be measured by hooking a wirelike probe in side gate groove in tumbler and then twisting tumbler until tit engages key plug or shell. Amount of twist permitted is function of angular position required to register tumbler groove with side gate and device can be calibrated to give direct reading of such angle. To defeat depth of cut decoder, twisting tumbler lock wherein tits on tumblers are located at different distances from tops of tumblers is disclosed. Another form of modified twisting tumbler locks that will defeat decoding methods and apparatus herein is tumbler with side gates receiving grooves 180° apart and with no tit.

14 Claims, 15 Drawing Figures

100
101
103
105
107
109
111
112
114
120
124
126
128
130
132
134
135
136
138
140
28
56
200
202
204
206
208
210
211
212
214
215
216
218
222
224
226
228
230
L
C
R
1
2
3
4
5
6
9

METHOD AND APPARATUS FOR DECODING TWISTING TUMBLER LOCKS AND LOCKS RESISTANT THERETO

BACKGROUND OF THE INVENTION

1. Field of the Invention

This invention relates to twisting tumbler locks and particularly to a method and apparatus for decoding twisting tumbler locks. The invention further relates to improvements in twisting tumbler locks for defeating the decoding methods and apparatus.

2. The Prior Art

Twisting tumbler locks typified by the cylinder lock described in U.S. Pat. No. 3,499,302, granted to R. C. Spain et al. on Mar. 10, 1970, for Cylinder Lock have had an enormous impact on the lock industry. Such locks, which rely not only on the vertical positioning of the tumblers so that their upper surfaces are in the shear plane of the cylinder but further rely on the angular position of the tumblers in order to free a reciprocable movable side bar which serves as an supplementary locking means. Because there are two variables encountered with respect to each tumbler in order to properly position that tumbler into the "unlock" position, locks of this type have been to date highly pick resistant.

Locks of the type described in the aforementioned Spain et al U.S. Pat. No. 3,499,302 are sold in the United States under the registered mark MEDECO and are manufactured by the Medeco Security Locks Inc. of Salem, Virginia. These Medeco locks, while embodying the invention of said aforementioned U.S. Pat. No. 3,499,302 somewhat differ structually from the structures described and claimed in said patent.

The Medeco locks, which are now widely employed have posed serious problems to locksmiths, especially on what is generally called a "lockout". In a lockout, the authorized occupant of premises protected by a Medeco lock has misplaced his key and is unable to gain normal entry to the premises. When a locksmith is summoned, the locksmith is usually unable to employ the normal picking techniques used on many other types of cylinder locks in order to open the lock to gain entry. Thus, locksmiths often find themselves in a position where they must destroy the lock or the door supporting the lock in order to gain entry for the occupant. Such crude techniques are repugnant to locksmiths. This has tended to discourage their recommending Medeco locks for use by their customers.

SUMMARY OF THE INVENTION

The present invention is directed to methods and apparatus for decoding and opening Medeco locks and other locks incorporating the twisting tumbler principle described and claimed in said aforementioned U.S. Pat. No. 3,499,302. Specifically, as presently manufactured by Medeco Security Locks Inc., each of the twisting tumblers in the Medeco lock is provided at its upper end with a small protrusion or tit which projects into a wide slot in the cylinder wall that cooperates with the tit to limit the amount of twist that the tumbler can experience during operation. Since the depth of the cut of a key for moving the upper end of the tumbler into coplanar relation with the shear plane is a function of the length of the tumbler, the depth of the cut in a key to produce a bit that will vertically shift the tumbler so that its upper end is in the shear plane can be determined by measuring the length of the tumbler. The present invention is directed in part to an apparatus which is insertable into the keyway of a Medeco lock and which is provided with a feeler that maybe extended until it engages the tit on the upper end of the tumbler. The amount of extension is a function of the length of the tumbler and gives a direct read-out of the depth of cut for the key bit necessary to cooperate with the measured tumbler to move it vertically so that its upper end is in the shear plane of the cylinder. Likewise, as the Medeco lock is presently manufactured, the angular position of the tumbler required to register the groove with a protrusion on the side bar to free the side bar for lateral movement is a function of the angular relationship between the groove in the tumbler and the tit thereon. This angular relationship can be determined by hooking a member onto the groove of the tumbler and then rotating the tumbler until the tit engages one edge of the tit receiving slot in the cylinder. The amount of rotation necessary to effect engagement between the tit and the cylinder the slot wall is directly proportional to the required angular position for the particular tumbler in order to move into non-obstructing relation with the side bar. Thus the angulation of the bit necessary to operate the tumbler to its unlock position can be determined.

Finally the present invention is directed to modifications in the standard Medeco lock as presently manufactured and sold by the Medeco Security Locks, Inc. in order to resist such decoding techniques as just described. Specifically, if the tumblers are constructed with tits at random heights relative to the upper end of the tumbler rather than all at the upper ends of the tumblers, the depth of cut decoding mechanism can be defeated. Alternatively, if the tumbler is provided with two diametrically opposed slots for receiving the side bar protrusion and there is no tit then the angular position detecting mechanism and method will be defeated and the depth detecting mechanism will be made more difficult, if not impossible, to employ.

DETAILED DESCRIPTION OF PREFERRED EMBODIMENTS

Figure 1:
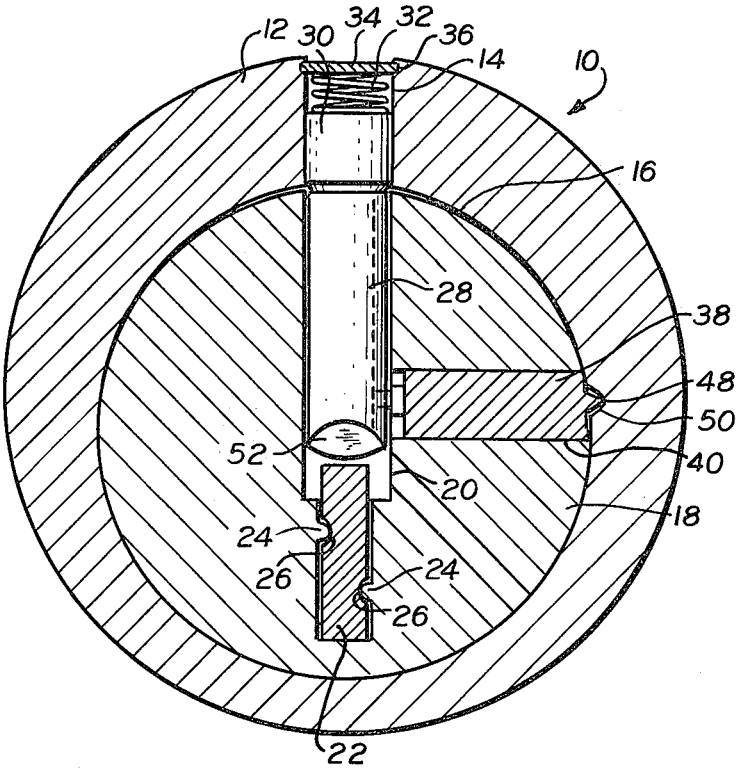
FIG. 1. PRIOR ART
FIG. 1 is a sectional view of a Medeco mortise or rim cylinder lock as presently manufactured by Medeco Sercurity Locks, Inc. and sold under the trademark MEDECO.
Figure 2:
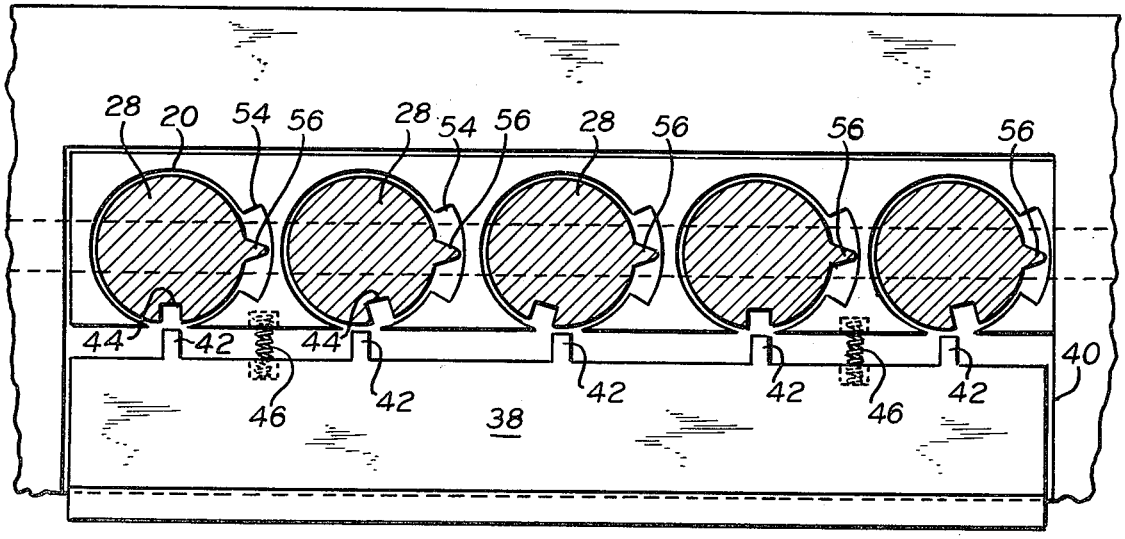
FIG. 2. PRIOR ART
FIG. 2 is a fragmentary top view of the lock shown in FIG. 1.

Mortise and rim cylinder locks manufactured under the trademark MEDECO by Medeco Security Locks, Inc. of Salem, Virginia are well known to the skilled art worker. Many essential features and the mode of operating of such a lock are illustrated in a publication by Medeco Security Locks, Inc. entitled "Twisting Pins Make Medeco The Most Unpickable Lock Cylinder Money Can Buy!" Said publication is hereby incorporated by reference. The lock illustrated in said publication is contructed in most essential features in accordance with the aforementioned U.S. Pat. No. 3,499,302 granted to R. C. Spain et al. on Mar. 10, 1970 for Cylinder Lock, which patent is also hereby incorporated by reference. The essential features of the commerically available Medeco lock, hereinafter referred to as a "twisting tumbler lock" is illustrated in FIGS. 1 and 2. Such a lock is designated generally by the reference numeral 10 and incorporates a cylinder shell 12 having a plurality of vertically extending holes 14, here shown by way of illustration as five in number, at the upper end thereof. The cylinder shell is also provided with a central bore 16 in which the key plug 18 is rotatably mounted. The key plug 18 is provided with a like number of apertures 20 as the number of apertures 14 in cylinder shell 12, which apertures 20 are registerable with the apertures 14. At the bottom of the key plug 18 there is a longitudinally extending slot which serves as the key way 20 for slidably receiving a key 22. Preferably the keyway 20 is provided with one or more longitudinally extending ridges 24, here shown by way of illustration as two in number (although four are normally employed by Medeco) and, to enable the key 22 to be slid into the keyway 20, the key must have grooves 26 complementary to the ridges 24. Generally speaking, the lock is mounted in the position shown in FIG. 1 so that the apertures 14 and 20 when registered are vertical. This positioning is not essential to the operation of the lock but it is normal and the lock will hereinafter be so described and claimed, but without limitation intended.

Slidably mounted in each of the apertures 20 is a cylindrical tumbler 28 that is movable vertically and is rotatable within the aperture 20. As manufactured by Medeco Security Locks, Inc., a driver 30 is disposed above each of the tumblers 28 and in abutting relation therewith. The upper end of the drive 30 is in engagement with a compression spring 32, the opposite or upper end of which engages a plate 34 that is slidably mounted in a grooved plate way 36 at the upper end of the cylinder shell 12.

As is true of most cylinder locks, in order for the lock plug 18 to be rotated relative to the cylinder shell 12, each of the tumblers must be vertically oriented so that the plane defined by the engagement of the tumblers 28 and their associated drivers 30 is coplanar with the surface of the key plug, which surface is commonly designated as the shear plane. Thus, to unlock a twisting tumbler lock, as is true of other more conventional mortise and rim cylinder locks, the key 22 must have cuts or bits in it which will engage the lower ends of the tumblers 28 and shift the tumblers vertically so that their upper ends are disposed in the shear plane.

What distinguishes the twisting tumbler lock from other conventional tumbler locks is the fact that the tumblers must not only be vertically oriented as just described, but they must also be properly angularly oriented as well. It is this feature which brings about the significant resistance of the twisting tumbler lock to standard picking techniques.

The reason for the angular position of each of the tumblers being critical to unlock the lock 10 is that provided in the lock plug is a longitudinally extending side bar 38 that is transversely or laterally slidable in a complementary slot 40 in the lock plug from an outer or extended position which is shown in FIG. 1 to a retracted position shown in dotted lines in FIG. 1. The side bar 38 is provided with a plurality of laterally extending protrusions 42, one for each tumbler, which protrusions are preferably trapezoidal in configuration and which normally engage the cylindrical surfaces of the tumblers to prevent lateral movement of the side bar to its retracted position. A pair of compression springs 46 seated between the front surface of the side bar 38 and the opposed surface of the milled out slot 40 for the side bar bias the side bar to its extended position. At the remote or right hand surface of the side bar 38 as reviewed in FIG. 1, there is a V-shaped protrusion 48 that is complementary to a V-shaped notch 50 in the interior wall surface of the cylinder shell. Thus, in its normal position, the side bar V-shaped protrusion 48 is interengaged with the V-shaped notch 50 to prevent rotation of the key plug 18, which prevention is independent of the locking effect provided by one or more of the drivers 30 straddling the shear plane of the lock. Thus, even if all of the tumblers are moved to their proper vertical positions to align their upper surfaces with the shear plane, so long as the side bar 38 is in its right or solid line position as shown in FIG. 1, the lock 10 cannot be unlocked. That is to say, the key plug cannot be turned.

To permit retraction of the side bar to deactivate its independent locking effect, each of the tumblers 28 is provided with a vertically extending slot or groove 44 which are preferably complementary in shape to side bar protrusions 42. When the slots are aligned with the protrusions 42, and the key plug 44 is torqued as by twisting the key 22, if all of the tumblers are properly vertically positioned, the torque will result in a camming action between the protrusion 48 and the V-shaped groove 50 to force the side bar 38 inwardly from its solid line position to its dotted line position, in which position the protrusions 42 are disposed in the grooves 44 in the tumblers. In this position, the key plug is free to rotate — the lock 10 is unlocked.

To effect a twisting of the tumblers 28 in order to bring the grooves 44 into proper alignment with the corresponding protrusions 42 in the side bar, the bottoms of the tumblers 28 are chisel shaped as at 52. As is described in detail in the aforementioned Spain et al. U.S. Pat. No. 3,499,302, the bits or cuts on the key 22 are angulated so as to impart a twist to the tumblers. If the bits are properly angulated, they will cause the tumblers to assume an annular position, such that the grooves 44 in the tumblers are in register with the associated protrusions 42 in the side bar. The Medeco lock is constructed to twist the tumbler to one of three positions commonly referred to as "Left", "Center" and "Right".

As presently manufactured by Medeco Security Locks, Inc., means are included to assure that the tumbler will be in an angular position so that when its chisel shaped bottom end 52 engages its associated angulated key bit and is twisted to the appropriate position, the slot 44 will be in register with the protrusion 42 and not 180° out of phase therefrom, as would be possible without such a means.

In the Spain et al. patent, the means for limiting the amount of twist of the tumblers comprises a wide groove designated in said patent by the reference character 67, which groove extends longitudinally in each of the tumblers and cooperates with a protrusion or tit 39 on the key plug, which tit extends into said groove 67. However, manufacturing the cylinder lock of the Spain et al. patent is inconvenient and expensive. Thus, in the Medeco lock as not manufactured pursuant to said Spain patent, the parts are reversed and the tit is provided at the upper end of each of the tumbers 28, which tit extends into a rather wide vertically extending groove in the key plug, which groove is in direct communication with the vertically extending aperture 20 in which the tumbler 28 slides. This structure is illustrated best in FIG. 2 of the present drawings wherein the wide angle groove in the key plug is designated by the reference character 54 and the cooperating tit 56 is provided at the upper end of each tumbler 28. Clearly, the interengagement of the tit with the two sides of the groove 54 limits the extent of angular twist of the tumbler 28 to thus maintain it in a position such that when a key with the appropriate bit angle is inserted into the keyway, it will twist the tumbler 28 so that the groove 44 registers with its associated side bar protrusion 42 and is not located a 180° therefrom.

However, it will be obvious to anyone skilled in the art that the angular position of the tit 56 relative to the front edge of the groove 44 in any tumbler is determined by whether or not the tumbler must occupy either its left angular position, the center angular position or the right angular position in order to register its groove 44 with its associated side bar protrusion 42.

The foregoing description sets forth sufficient of the structure of the currently commercially available twisting tumbler locks manufactured under the trademark MEDECO by Medeco Security Locks, Inc. to fully comprehend the inventions herein to be described and claimed. All of the above is clearly in the prior art and is readily available and known to locksmiths and all other skilled art workers.

In accordance with the present invention, two separate devices are employed to decode eacn of the twisting tumblers 28. One device is employed to determine the depth of cut of the bit on the key 22 necessary to properly vertically orient the tumbler so that its upper edge is in the shear plane of the lock; a second device is employed for decoding each tumbler to determine the angulation of the key bits in order that the bit will angularly orient the tumbler to register the tumbler groove 44 with its associated side bar protrusion.

Figures 3, 4, 5, 6, 7, 8, 9:
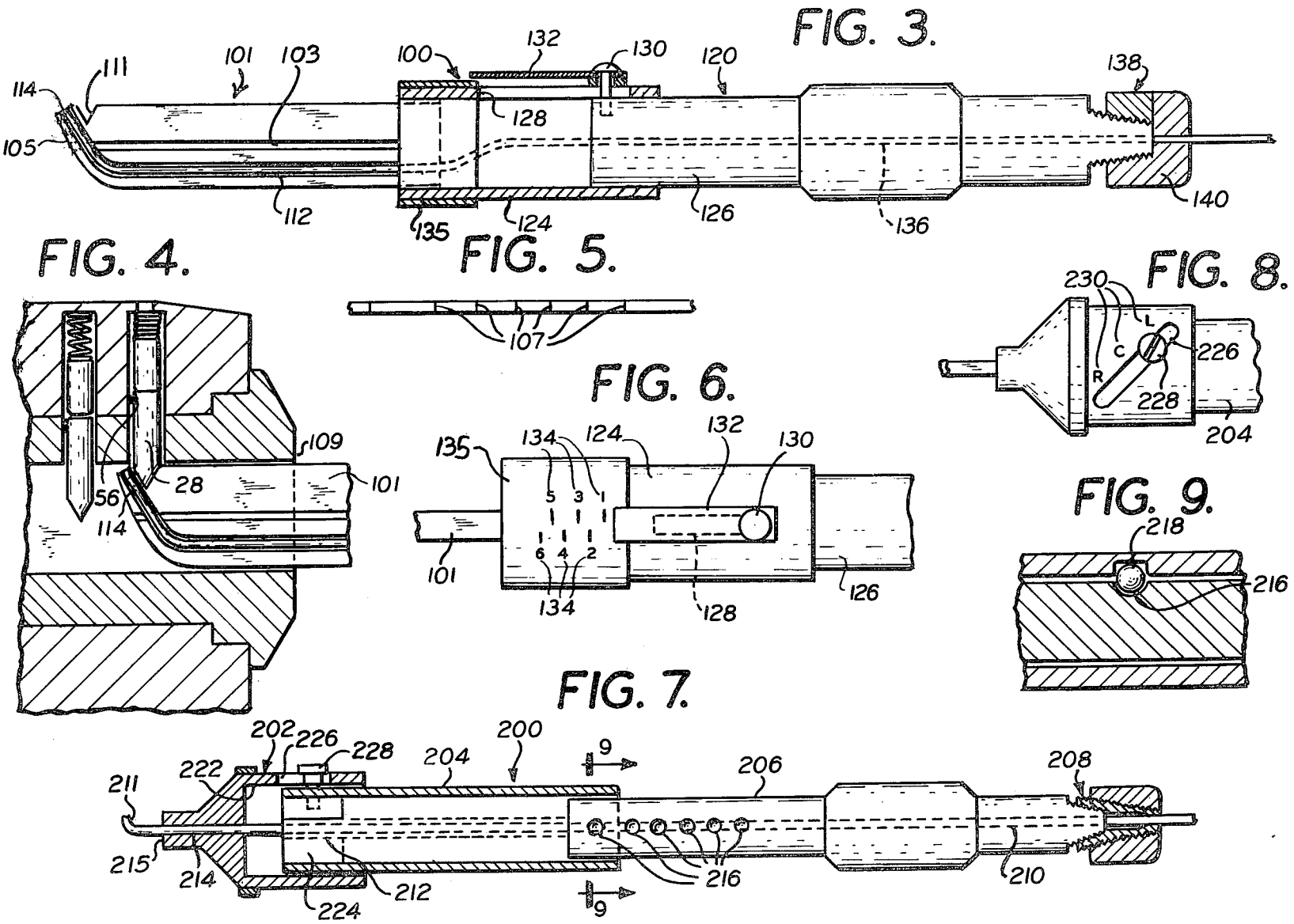
FIG. 3 is a side elevational view of a depth of bit decoder for use with the lock of FIGS. 1 and 2.
FIG. 4 is a fragmentary view partly in section and partly in elevation illustrating the mode of operation of the depth of bit decoder.
FIG. 5 is a fragmentary top plan view showing the front end of the depth of bit decoder.
FIG. 6 is a fragmentary top plan view showing a central portion of the depth of bit decoder.
FIG. 7 is a view partly in plan and partly in section showing an angle of bit decoder for use with a Medeco lock.
FIG. 8 is a top plan view of the front end of said angle of bit decoder.
FIG. 9 is a sectional view taken along the line 9—9 in FIG. 7.

To measure the depth of cut, all that is required is to measure the distance from the bottom of the tumbler to its angle limiting tit 56 which is located at the top of the tumbler. This distance is directly proportional to the depth of cut for the key bit that will underlie the particular tumbler to properly vertically orient it. FIGS. 3 and 4 illustrate an apparatus for decoding the depth of cut of each particular bit, which device, generally designated by the reference numeral 100, will be termed a depth of bit decoder.

Referring now to FIGS. 3 and 4, the depth of bit decoder comprises a flat enlongated blade 101 which is provided with longitudinally extending grooves and ridges 103 that are complementary to the ridges and grooves 24 in the keyway, whereby to enable the sliding insertion of the blade 101 into the keyway in a manner of a standard key for the lock. As illustrated in FIG. 4, the blade 101 is inserted into the keyway until the front of it underlies a tumbler 28. To accurately determine the degree of insertion of the blade 101 into the keyway 26 for cooperation with each of the individual tumblers, indicia 107 are preferably provided on the upper edge of the blade 101, which indicia represent each of the tumbler positions in the lock 10. As best shown in FIG. 5, the indicia 107 are six in number to correspond to a six pin Medeco lock. However, the same indicia may be employed with a five pin lock or a four pin lock merely by omitting reference to the one or two rightmost indicia 107 as seen in FIG. 5. When any of the indicia 107 is in alignment with the front of key plug 109, the notch 111 adjacent the front of blade 110 will have the corresponding tumbler 28 seated therein as shown in FIG. 4.

When the blade 101 is inserted to engage the outermost tumbler 28, which position will be determined by the first indicia 107 registering with the front edge 109 of the key plug, the device 100 is located properly for measuring the depth. The depth is measured by a resilient, relatively stiff wire 114 that is slidably positioned in a complementary slot 112 in the side of the blade 101. The left end of the slot 112 is upwardly extending to direct the left end of the wire 114 upwardly as it is advanced. As will be more fully understood hereinafter, the wire 114 can be advanced relative to the blade 101, which advancement, due to the shaping of slot 112, will cause the wire 114 to move upwardly within the corresponding slot 54 in the key plug until the wire engages the tit 56 that is located at the top of the tumbler. At that point, there will be resistance to further advancement of the wire. The amount of advancement, as will be seen hereinafter, is readily measureable by the device 100 and this measure can be calibrated in terms of depth of bit cut.

The advancement of wire 114 is controlled by the relative movement between a handle 120 and the blade 101. Specifically, to the right end of blade 101 is a hollow sleeve 124 which slidingly receives the cylindrical forward portion 126 of the handle 120. Sleeve 124 is provided in its upper surface with a longitudinally extending slot 128 through which extends a screw or rivet 130 for securing an elongated longitudinally extending pointer 132 at the outside thereof. Pointer 132 cooperates with staggered indicia 134 on a friction fitted movable sleeve 135 that is slidably mounted on sleeve 124 at the left front thereof. Indicia 134 are calibrated in depth of bit cut necessary to position the upper end of the tumbler 28 being decoded in the shear plane. Preferably, the indicia are located on sleeve 135 so that with pointer 132 proportioned as shown, it will progressively cover the indicia as the wire 114 is advanced leftward as viewed in FIG. 3. The indicia are located on the sleeve to provide a simple means for accurately calibrating the device 100 so that the readout will in fact correspond with the position of the front of wire 114.

With the wire 114 fixed to the handle in a manner to be described hereinafter, when the handle is moved leftward to slidably advance the handle portion 126 relative to cylinder 128, which movement is permitted by virtue of the screw 130 being disposed within the slot 128, the wire 114 will move upwardly until it engages the tit 56 of the tumbler 28. Upon engaging the tit, which engagement, as already noted is readily detectable by resistance to further movement, all that the user of the device 100 need do is note which indicium 134 the pointer 132 is pointing to and record the indicium. That indicium informs the user of the depth of cut necessary for a key bit to properly vertically locate the tumbler 28 so that its upper end is in the shear plane.

Since, as will be obvious to the skilled art worker, the initial position of the wire 114 is critical to getting an accurate reading of depth of cut, the wire is adjustably positional to be sure that it is always properly located relative to the pointer 132. This is accomplished by providing the handle 120 with a central channel or passage 136 through which the wire may extend to the rear of the handle 120 where it may be frictionally engaged by a conventional threaded chuck 138 to releasably hold the wire in any desired position. Thus, an additional amount of wire 114 is generally provided for the device 100 so that it may be moved back and forth from the righthand end until the front of the wire is properly located relative to the front of the blade 101. At that point, the nut 140 of the chuck 138 may be tighten to clampingly engage the wire 114 at the righthand end of the handle and hold it in that position.

It will be obvious that the blade 101 of depth of bit decoder 100 will be inserted increasingly far into the keyway 26 of the lock 20 to be located adjacent each of the tumblers 28 sequentially and when it is so located with respect to each of the tumblers, as indicated by the indicia 107 on the top of the blade 101, the handle is advanced relative to the blade whereby to advance the front end of the wire until it engages the tit 56. After the wire engages the tit, the pointer 132 is viewed and the indicium 134 to which it is pointing is recorded for the particular tumbler position. When that is accomplished, the handle is retracted to retract the wire 114 to prevent damage to it and then the blade 101 is moved leftward as viewed in FIG. 4 until it comes to the next tumbler 28 which position is also readily detectable by determining that the next indicium 107 is coplanar with the front surface 109 of the key plug. In this manner, the depth of each bit can be measured sequentially and can be recorded. Thus, the depth of bits for the key for the lock 10 is readily decodable.

It will be obvious that the depth of bit decoder 100 may be employed on conventional pin tumbler locks (not of the twisting tumbler type). In such use, the feeler 114 is employed to detect the surface discontinuity between the upper end of the tumbler and the lower end of its associated driver. This aspect of this invention is thus not limited to use with twisting tumbler locks.

The means for decoding the angular position of each of the tumblers 28 necessary to register slot 44 with the associated protrusion 42 on the side bar 38 is illustrated in FIGS. 7 through 9 and is generally designated by the reference numeral 200. Angle decoder 200 comprises a tip 202, an intermediate cylindrical fitting or base 204, and a handle 206. At the righthand end of the handle 206 is a standard threaded type chuck 208 which frictionally holds the righthand end of a stiff probe wire 210 that extends essentially along the longitudinal axis of the decoder 200 from one end to the other. The left end of probe wire 210 is hooked as at 211. While wire 210 is fixed relative to the handle 206, it is longitudinally movable relative to the intermediate part 204 and the tip 202, by virtue of its passing through central passages 212 and 214 respectively thereof with clearance. The central portion 204, as already noted, is essentially hollow and receives with a sliding fit the left end of the handle 206. Handle 206 is provided with a plurality of semi-spherical depressions 216, one for each tumbler 28, which depressions 216 are spaced apart the same distances as are the tumblers 28. As best seen in FIG. 9 mounted on the interior of the cylinder 204 is a spring pressed ball 218 which is adapted to releasably engage each of the complementary shaped depressions 216 to releasably fix the relative positions between the handle 206 and the cylinder 204, which positions correspond to the locations of the tumblers 28 in the lock 10. The significance of this will become apparent hereinafter.

The tip 202 is also movable relative to cylinder 204. Specifically, the tip 202 is provided with a cylindrical cavity 222 at its right or rear end, which cavity receives the front end of the cylinder 204 with close sliding clearance. The front end of the cylinder 204 is provided with a press-fitted plug 224. A helically extending slot 226 (see FIG. 8) is provided in the wall of the tip 202 through which extends a screw or other headed securing element 228 that is fixed to the plug 224. The head of securing element 228 is wider than the width of the slot 226 to prevent inadvertent disengagement of the tip 202 from the cylinder 204. It will be obvious that the tip 202 can be moved forwardly or rearwardly relative to the cylinder 204 by twisting the tip.

In use, the decoder 200 is set so that the cylinder 204 and the handle 206 are in such relative position that the ball 218 is disposed in the leftmost depression 216 whereby to cause the wire feeler 210 to be in its rightmost or retracted position relative to the tip 202. Further, the tip is twisted relative to cylinder 204 to cause, by interrear action of the slot 226 and the screw 228, a leftward movement to cylinder 204 and handle 206 whereby to locate the front surface 215 of the tip as far as possible from the hooked end 211 of the wire probe 210. When the tip is in this described position, t... screw will be in the rightmost part of the slot 226 as viewed in FIG. 8.

With the instrument 200 so conditioned, it is rotated to have the hooked end 211 pointing slightly more than 90° from the upper vertical and in a leftward or counterclockwise direction and in that orientation the hooked end is inserted into the keyway to the full extent permitted in the tip 202. When the front surface 215 of the tip 202 engages the outer surface 109 of the key plug, hook 211 is in approximate alignment with the groove 44 in the first tumbler 28 to be encountered. In that position, the entire instrument is rotated in a clockwise direction to move the hook 211 into the slot 44 of the adjacent tumbler 28. Sometimes, to effect the hooking engagement of the hook end 211 with the slot 44, some slight jiggling may be required. When the hooking is accomplished, which is readily detectable by the feel of the instrument, it no longer being easily retracted from the keyway, the entire instrument is moved outwardly away from the lock to the maximum extent permitted by the rotation of the tumbler. However, the rotation of the tumbler is limited by the tit 56 engaging one end of the twist limiting slot 54. In this limiting rotational position, the front end surface 215 of tip 202 will be spaced from the front surface 109 of the key plug 8.

As the angular position of the tumbler 28 required to bring the slot or groove 44 into register with its associated side bar protrusion 42 is related to the angular relation between the slot 44 and the tit 56, the distance between the surfaces 215 and 109 is directly related to the appropriate angular position for the tumbler being decoded. All that need be done is determine that proper angular position is to measure the distance between surfaces 109 and 215. That distance measurement is accomplished by rotating tip 202 relative to cylinder 214 in order to bring the front surface of the tip 202, that is the surface 215, back into engagement with the surface 109. When the two surfaces engage, the screw 228 will be located in one of three positions in the slot 226, which positions are defined by indicia 230 that read "R", "C", and "L" corresponding to right, center and left angles for the key bit to properly twist the tumbler being decoded to its unlock position. Thus, a direct readout of the proper angle for the associated key bit can be obtained. After the angle has been determined, the tip is rotated again to its fully retracted position, the entire implement is rotated counterclockwise to orient the tip slightly more than 90° from the upper vertical in a counterclockwise direction and the instrument is withdrawn. Then, the handle 206 is forced leftward relative to the cylinder 204 to cause the spring pressed ball to yield and permit the movement until the ball registers with the next depression 216 whereby to extend hook 211 outward from surface 215 by a distance equal to the spacing between tumblers to condition the instrument for decoding of the angle of the next tumbler. Then the entire series of steps is repeated for the next tumbler and for each successive tumbler in the lock.

In actual use, it has been found desirable in decoding locks of the twisting tumbler type, such as sold by Medeco, to first decode depth of cut of each of the bits for the key for the lock and record those depths in accordance with the numbers 1 through 6 which correspond to well known standardized depths of cut for Medeco keys. After the depths of cut have all been determined, the depth of cut decoder 100 is laid aside and the bit angle decoder 200 is operated to successively decode the proper angle for each of the bits in sequence whereby to give the locksmith both the depth of cut of each key bit and its appropriate angle. With that done, the locksmith may cut a key for the lock 10 that has been decoded, which key cutting operation can be performed at the locksmith's shop or in the field by use of a portable key cutting machine such as described in U.S. Pat. No. Re 27,665 to R. C. Spain on June 12, 1973. Irrespective of where the key is cut, the lock may now be opened without destroying it or the door in which it is mounted.

Figure 10:
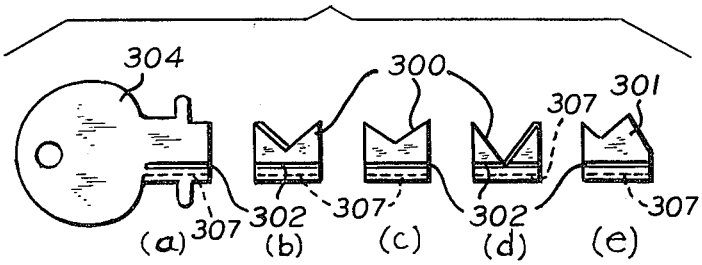
FIGS. 10 *a*, *b*, *c*, *d* and *e* are side elevational views a key bit fragments which may be employed to open a decoded Medeco lock.
Figure 11:
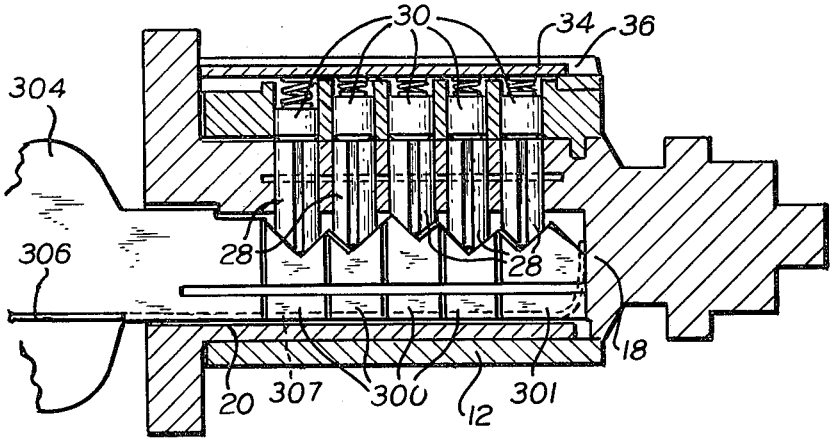
FIG. 11 is a sectional view of a Medeco lock which has been opened by a group of key fragments as illustrated in FIG. 10.

In accordance with another feature of the present invention and as illustrated in FIGS. 10 and 11, another means of opening the decoded lock without cutting a key may be employed directly in the field. Specifically, the locksmith may carry with him a kit which includes a multiplicity of key portions which include bits of every possible description. That is, there will be a plurality of bits corresponding to the depth of cut "6", some with a left angle cut, some with a center or transverse angle cut and some with a right angle cut (not 90°, but extending rightwardly). There will be a plurality of bits with a No. 5 depth cut, some with a left angle cut, some with a center or transverse angle cut and some with a right extending angle cut, and so on. Examples of such bits are shown collectively in FIG. 10(*b*), (*c*) and (*d*). Special bits will be provided for the front end as illustrated in FIG. 10(*e*) by the bit designated by the reference character 301. There will be front end bits of each depth and angle. Note that each of the bits is provided with grooves 302 on both side (one side only being shown) which grooves in all ways correspond to the grooves 26 in the key 22. Finally, as illustrated in FIG. 10(*a*), a torquing member 304 is provided in the kit, which torquing member is insertable into the keyway a distance that falls short of the first tumbler. The torquing member 304 will function as the standard gripping portion or handle of a normal key.

The locksmith may select from his multiplicity of bits the five or six bits appropriate for the five or six tumblers (or in some instances four tumblers) of the Medeco lock which has been decoded. He will then insert a small wire hook 306 into the keyway to extend along and the bottom thereof, the forward end thereof going all the way to the inside end of the keyway 20. The righthand end of the hook will extend out beyond the key plug for reasons that will become apparent hereinafter. With the hook so inserted, the bits corresponding to the appropriate tumblers may be slid one after the other into the keyway, each bit having a bottom groove 207 to receive hook 306 and each successive bit will push those ahead of it towards the rear or closed end of the keyway. When all of the appropriate bits are inserted, the torquing member 304 may be inserted and it may be turned to turn the key plug which is now unlocked, the tumblers having been vertically moved and rotated so as to unlock the key plug. After the door has been opened and the normal key has been retrieved, assuming that it is in the premises, the lock may be turned again to its locked position and the torquing member 302 may be removed. Then, the wire hook 306 may be withdrawn and it will hook the innermost bit and pull it and all of the bits outward of it out of the keyway whereby to free the lock of the bits.

There are times when the various individual bits 300 do not provide good matching at their respective interfaces. This may be detected by laying out the bit arrangement on a table before the bits are inserted into the lock. If undue discontinuity is encountered, the confronting edges can readily be filed down in order to provide a good smooth transition from one bit to another. Thus, no key is required to open a lock in the field once it has been decoded in accordance with the aforementioned methods and by the aforedescribed apparatus.

Figure 12:
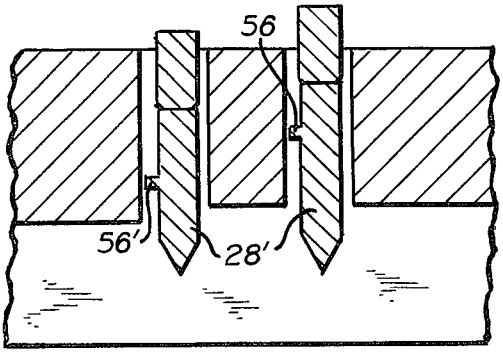
FIG. 12 is a fragmentary view of a twisting tumbler lock key plug embodying a tumbler array that would resist decoding.
Figure 13:
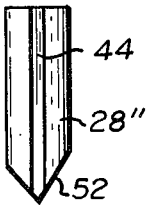
FIG. 13 is a side elevational view of a tumbler for use in Medeco or other twisting tumbler lock which tumbler will resist the action of the angle of bit decoder of FIG. 5.
Figure 14:
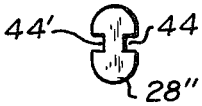
FIG. 14 is a top plan view of the tumbler of FIG. 13.

As is implicit and explicit in the foregoing description, the commercially available Medeco mortise and rim cylinder locks are highly resistant to unauthorized opening which resistance spills over to a resistance to authorized opening on a lockout. The foregoing specification discloses modes and means for overcoming this resistance by authorized and skilled locksmiths. However, it is recognized that in some instances, it may be desired to defeat the techniques and apparatus hereinbefore described for decoding and opening Medeco locks. FIGS. 12 through 14 disclose means for accomplishing this.

Specifically, with reference to FIG. 12, one simple means for defeating the depth decoder is to employ the tumblers 28' which have their twist limiting tits 56' at random heights relative to the upper end of the tumblers. With such a structure, the method and apparatus for detecting the depth of bit cut, which apparatus is hereinbefore been designated by the reference numeral 100, will not be able to give an accurate readout. Thus, the entire decoding method can be defeated.

Likewise, FIGS. 13 and 14 illustrate a modified form of tumbler for incorporation in the lock 10, which tumbler, if substituted for the tumblers 28 of FIG. 1, will increase the difficulty of employing the depth decoding device 100 and will completely obviate the use of the angle decoding device 200 of FIGS. 7 and 8. Specifically, the tumbler 28'' of FIGS. 13 and 14 will have the same chisel-like end 52 at the bottom for being twisted by the facets of the operating key bit to align the side bar receiving slot 44 with the associated side bar protrusion. However, in accordance with this modification, a second slot 44' 180° away from the usual slot 44 is also included. By providing two slots 44 and 44', the need for limiting the angle of twist is obviated. That is to say, it does not any longer make a difference to the operation of the lock whether the side bar enters the slot 44 or enters the slot 44'. This being the case, there is no longer any need for limiting the amount of twist of the tumbler 28''. That is to say, it can assume upon operation by the key bit its normal position or a position 180° therefrom, which two positions are the only positions that it can assume given the chisel-like bottom 52 and the angulated form of the bits. Thus, there is no need for a tit 56 at any place on the tumbler 28'' nor is there a need for the twist limiting slot 54 in the key plug, which slots now serve to cooperate with the tits to limit the amount of twist. Without any twist limitation from a tit 56 and its associated slot 54, it will be obvious that when the angle detector 200 is employed, there will be no stop in order to determine the relative angular position between a tit and the slot. Thus, the operation of the detector or decoder 200 will be defeated. Likewise, the depth of cut detector 100 will also not operate with the reliability that can now be achieved with the present Medeco structure. That is to say, while it will still be possible for the depth of bit detector to detect the discontinuity at the top of the tumbler 28'', this is not as dramatic a detection as when the feeler 114 engages a tit 56 and it may be overlooked by people of only modest skill. Thus, the structure of FIG. 13 and 14 is able to defeat the angle detector and render the depth detector less suitable.

An additional advantage of the structure of the tumblers of FIGS. 13 and 14 is that the slots 44 and 44' can be provided in the tumbler during the extrusion of small rods, thereby reducing the cost. There will be no need to strike the tumbler to provide the protrusions or tits 56 and the only mechanical process beyond extrusion will be that necessary to define the chisel-like bottom surface 52.

Figure 15:
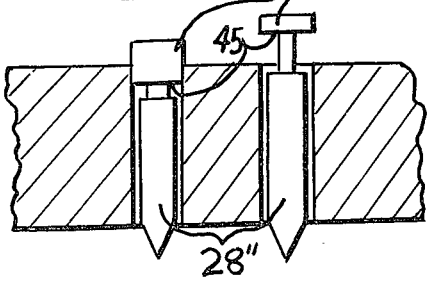
FIG. 15 is a view similar to FIG. 12 showing still a further lock modification.

A still further improvement on the modification shown in FIGS. 13 and 14 is illustrated in FIG. 15, wherein the tumblers 28'' having opposed longitudinal extending grooves 44 and 44' (not shown in FIG. 15) are employed as suggested in FIGS. 13 and 14. This, as already noted, provides good resistance to angulation decoding. To provide additional resistance to depth of bit decoding, the drivers 30' are employed, each of which is undercut adjacent the upper surface of the tumblers 28'' and, as shown, to a different longitudinal distance. By varying the longitudinal extent of the undercut 45, the depth of bit decoder 100 will not yield a proper decoding.

While we have shown and described the preferred forms of the present invention and have suggested modifications thereto, other changes and modifications may be made therein within the scope of the appended claims without departing from the spirit and scope of this invention.

What is claimed is:

1. A method of decoding the depth of bit cut for a key for a twisting tumbler lock of the type which includes a side bar; a plurality of tumblers each of which includes a chisel shaped bottom, a vertically extending slot for receiving a portion of said side bar and a twist limiting tit at the upper end; and a key plug having a plurality of holes, one for each tumbler in which said tumbler is slidably and rotatably positioned, said holes each having a longitudinally extending slot for receiving the tit on the tumbler associated therewith for limiting the rotation of said tumbler, said method comprising the steps of:

locating a resilient feeler adjacent the bottom of a tumbler adjacent said key plug slot associated with said tumbler;

advancing said feeler into said key plug slot until it engages the tit on said tumbler; and determining the distance said feeler was advanced into said key plug slot.

2. The method defined in claim 1, further comprising the steps of repeating said steps successively at each tumbler.

3. Apparatus for decoding the depth of bit cut for a key for a lock of the type including a rotatable key plug having a longitudinally extending keyway therein and a plurality of transversely extending longitudinally spaced holes, each communicable to and from a locking position and from and to an unlocked position wherein the end of said tumbler remote from said keyway is in the plane of the surface of said key plug, said apparatus comprising:

a longitudinally extending blade insertable into said keyway;

a handle operatively connected to the rear end of said blade and being longitudinally movable relative thereto; and a resilient longitudinally extending feeler secured to said handle for movement therewith relative to said blade, said resilient feeler extending along said blade with the front end of said feeler disposed at the front end thereof, said feeler being upwardly extending at the front of said blade, whereby when said handle is moved toward said blade, the front end of said feeler will move upwardly therefrom.

4. Apparatus for decoding the depth of bit cut for a key as defined in claim 3, further comprising means for indicating the extent of feeler movement.

5. Apparatus for decoding the depth of bit cut for a key as defined in claim 3, further comprising indicia means on said blade for indicating the depth of insertion of said blade in said keyway.

6. Apparatus for decoding the depth of bit cut for a key as defined in claim 4, further comprising indicia means on said blade for indicating the depth of insertion of said blade in said keyway.

7. The method of decoding the required angulation of bit for a key for a twisting tumbler lock of the type which includes a side bar; a plurality of tumblers each of which includes a chisel shaped bottom, a vertically extending slot for receiving a portion of said side bar and a twist limiting tit at the upper end; and a key plug having a plurality of holes, one for each tumbler in which said tumbler is slidably and rotatably positioned, said holes each having a longitudinally extending slot for receiving the tit on the tumbler associated therewith for limiting the rotation of said tumbler, said method comprising the steps of:

inserting an elongated member having a hooked front end into said keyway adjacent one of said tumblers;

hooking the slot in said one tumbler with said hooked front end;

then withdrawing said elongated member while still hooked on said tumbler until the tit on said tumbler engages the wall of the slot associated with the key plug hole in which said tumbler is mounted, whereby to prevent further withdrawal of said hooked elongated member; and measuring the distance of said withdrawal, whereby to indicate the angulation of the key bit associated with said tumbler.

8. The method of decoding the required angulation of bit for a key for a twisting tumbler lock as defined in claim 7, further comprising the steps of repeating said steps successively at each tumbler.

9. Apparatus for decoding the angulation of a bit for a key for a lock of the type including a rotatable key plug having a longitudinally extending keyway therein and a plurality of transversely extending longitudinally spaced holes, each communicating with said keyway, and a tumbler in each of said holes movable to and from a locking position and from and to an unlocked position wherein the end of said tumbler remote from said keyway is in the plane of the surface of said key plug, said apparatus comprising:

a base member;

a tip longitudinally movably mounted on the front end of said base member and having a passage therein;

a handle longitudinally movably mounted on the rear of said base member and having a passage therein;

an elongated member insertable in said keyway;

means for fixing said elongated member to said handle, said elongated member extending forwardly from said handle through the passages in said base member and tip and being longitudinally movable relative to said tip, said elongated member having a hooked end at the front of said tip.

10. Apparatus for decoding the angulation of a bit for a key as defined in claim 9, further comprising means for indicating the amount of relative movement between said tip and said base.

11. Apparatus for decoding the angulation of a bit for a key as defined in claim 9, further comprising means for releasably holding said handle in a plurality of positions relative to said base which corresponds to the location of said tumbler.

12. Apparatus for decoding the angulation of a bit for a key as defined in claim 9, wherein said tip and said base for circular in cross section and said base is telescoped with in said tip, said tip has a helically extending slot therein, and a beaded securing element fixed to said base and extending through said slot, said head being a greater diameter than the width of the slot, whereby rotation of said tip relative to said base imparts relative axial movement thereto, and indicia on said tip adjacent said slot for indicating the extent of said movement.

13. Apparatus for decoding the angulation of a bit for a key as defined in claim 12, further comprising means for releasably holding said handle in a plurality of positions relative to said base which corresponds to the location of said tumbler.

14. A cylinder lock comprising a cylinder shell and a key plug rotatably mounted therein, the interface between said shell and said key plug defining a shear plane, a keyway in said key plug, a plurality of cylindrical reciprocally and rotatably mounted tumblers in said key plug reciprocally movable to and from an unlock position in which an and of said tumbler is essentially in said shear plane and from and to a lock position, each of said tumblers having their other ends disposed adjacent said keyway and being chisel shaped, whereby when a key with angulated bite is disposed in said keyway, said tumbler will rotate, said key plug having a plurality of slots, one for each tumbler, adjacent each tumbler, a tit on each tumbler extending into its associated key plug slot for limiting the rotation of said tumbler, at least two of said tumblers having said tits at different distances from said first mentioned end of said tumbler, a side gate in said key plug being laterally movable from a lock position in which said side gate straddles said shear plane to an unlock position in which said side gate is clear of said shear plane, with tumblers normally blocking movement of said side gate to said unlock position, said tumblers being shaped so that upon engagement with a proper bitted key said side is free to move to said unlock position.

* * * * *